United States Patent [19]

Weller

[11] 4,080,771

[45] Mar. 28, 1978

[54] TRUSS ALIGNING SYSTEM

[76] Inventor: Victor Weller, R.R. No. 1, Lone Pine Drive, Port Sydney, Ontario, Canada

[21] Appl. No.: 609,711

[22] Filed: Sep. 2, 1975

[51] Int. Cl.[2] ..... E04B 7/06

[52] U.S. Cl. ..... 52/735; 52/105; 52/92; 52/370

[58] Field of Search ..... 85/13; 52/92, 93, 290, 52/241, 105, 735, 751, 752, 712, 697, 677, 300, 370, 690

[56] References Cited

U.S. PATENT DOCUMENTS

| | | | |
|---|---|---|---|
| 1,803,723 | 5/1931 | Murphy | 52/752 |
| 1,820,123 | 8/1931 | Donovan | 52/241 |
| 2,966,708 | 1/1961 | Freeman | 52/290 |
| 3,174,256 | 3/1965 | Lockwood | 52/546 |
| 3,360,892 | 1/1968 | Rosso | 52/93 |
| 3,423,898 | 1/1969 | Tracy | 52/92 |
| 3,601,428 | 8/1971 | Gilb | 52/751 |
| 3,668,828 | 6/1972 | Nicholas | 52/92 |
| 3,925,875 | 12/1975 | Doke | 52/241 |

FOREIGN PATENT DOCUMENTS

| | | | |
|---|---|---|---|
| 1,477,830 | 4/1967 | France | 52/92 |

*Primary Examiner*—Price C. Faw, Jr.
*Assistant Examiner*—Henry Raduazo

[57] ABSTRACT

An elongated member made of substantially flat metal stock is adapted to be used as a permanent member of a building structure to fix the spacing of structural members associated therewith, and to this end is provided with a plurality of pairs of laterally-spaced metal flanges located at modular distances therealong, the structural member of a building or truss being secured between successive pairs of flanges.

3 Claims, 4 Drawing Figures

Fig. 1
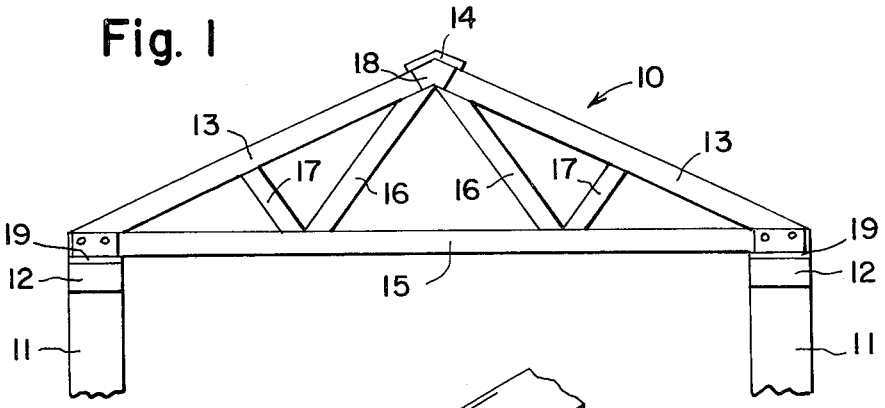
Fig. 2
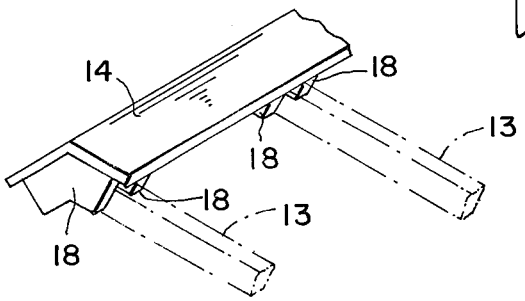
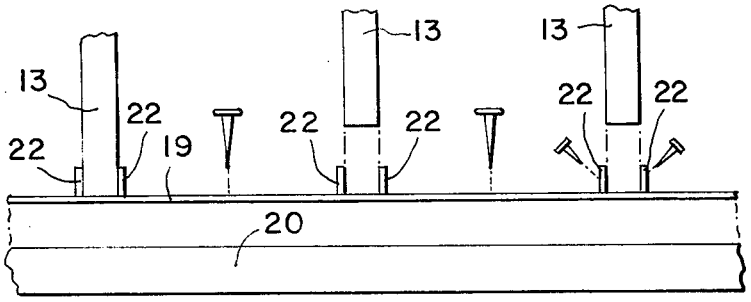
Fig. 3
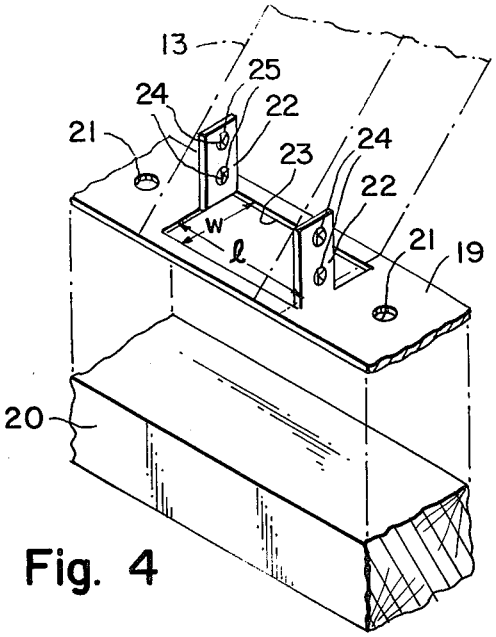
Fig. 4

TRUSS ALIGNING SYSTEM

BACKGROUND OF INVENTION

The instant invention relates, in general, to a structural component adapted to become a permanent part of a completed building or other structure its function, in particular, being to facilitate assembling and securing the various structural elements employed, i.e. girders, studs, rafters etc. For purposes of illustration, however, the invention is described as used in the construction of a roof truss but it will be understood that the invention is not limited to a roof truss and in fact may have a must broader application in the building industry.

The building art is replete with inventions relating to methods and means for fabricating roof trusses and in particular prefabricated metal trusses designed to be mass produced, to minimize shipping problems and to facilitate assembly at the building site. Typical of these inventions are those described and claimed in U.S. Pat. Nos. 2,365,579, Dec. 19, 1944; 2,652,599, Sept. 22, 1953; and 3,760,550, Sept. 25, 1973.

However, there is still considerable building being done without the use of prefabricated units and the instant invention is concerned primarily with improved method and means for facilitating this latter type of construction both from the standpoint of ease and accuracy of assembly.

SUMMARY OF INVENTION

The instant invention relates to a structural component to be used in the construction of a building, including a roof truss or the like, and to become a permanent part thereof. The function of the structural component of this invention is to facilitate assembly of the various structural members of the building and/or roof truss and in particular to fix the spacing of these structural members according to standard dimensions, e.e. at 16 or 24 inch centers, thus avoiding the necessity for making innumerable and time consuming measurements and the ever present possibility of costly errors. The structural component of this invention may take any one of several forms, two forms being shown by way of illustration. Thus the one form is as the crown or ridge of a roof truss. In this form the structural component comprises an elongated metal member substantially equal in length to the overall length of the roof truss, is substantially V-shaped in cross section, and has a plurality of pairs of laterally spaced flanges afixed to the underside thereof at standard distances or centers therealong, the spacing of the flanges of each pair of flanges corresponding substantially to the thickness of a roof rafter or similar structural member. In its other form the structural component of this invention may comprise an elongated substantially flat plate dimensioned to fit on the top-plate of a building frame and to be permanently secured thereto. A plurality of pairs of laterally spaced flanges are afixed to the elongated member at selected centers, i.e. 16 or 24 inches therealong, each flange being substantially perpendicular to the plane of the elongated member and the lateral-spacing of the flanges of each pair of flanges corresponding to the thickness of a roof rafter or equivalent structural member. Thus, when the structural component of this invention is used as the ridge member of a roof truss, and as a flat metal member secured to the top-plate of a building frame the several pairs of laterally spaced flanges of the ridge member and plate member, respectively, will be aligned so that when the roof rafters are mounted therein they will be automatically fixed on standard centers, be they 16 or 24 inches, as the case may be.

As an added feature of the invention the flanges of each pair of laterally spaced flanges are punctured to provide nailing apertures for securing the roof rafters thereto each aperture being formed with a burr in the inside face of its respective flange to bite into the rafter thereby insuring a rigid joint.

DESCRIPTION OF DRAWINGS

FIG. 1 is an end elevation of a building structure including a roof truss, the present invention being embodied in both the crown or ridge of the truss and in the top-plates of the structure;

FIG. 2 is a fragmentary, perspective view of one end of the truss ridge of this invention showing two roof rafters, in phantom, connected thereto;

FIG. 3 is a vertical side elevation of a fragmentary portion of the building structure including the structural component of this invention assembled on the top-plate; and FIG. 4 is an enlarged, fragmentary, exploded, perspective view of the top-plate and the structural component of this invention showing details of a pair of laterally-spaced flanges between which the lower end of a roof rafter, in phantom, is secured.

PREFERRED EMBODIMENT OF THE INVENTION

Referring now to the drawings FIG. 1 shows a roof truss indicated generally at 10 with fragmentary wall supports 11—11 each of which is provided with a top-plate 12. The roof 10 comprises rafters 13 adapted to be supported at their lower or outer ends on the top-plates 12, as hereinafter described, and at their upper ends in a crown or ridge member 14. Numeral 15 indicates a bottom cord of the truss, 16—16 the tension members of the truss and 17—17 the compression members, all as well known and fully understood by those skilled in the building trade.

The truss crown or ridge 14 is one form of the structural component of this invention and comprises an elongated member formed of relatively stiff, flat metal stock and substantially V-shapped in cross section. The overall length of the ridge 14 will correspond substantially to the length of the roof truss. Secured to the underside of the ridge member 14 and on both sides are a plurality of pairs of laterally spaced flanges 18—18, see especially FIG. 2, the spacing between each pair of flanges 18—18 corresponding substantially to the thickness of a roof rafter 13 or equivalent structural member, the upper ends of which are adapted to fit between the flanges 18—18 and to be secured therebetween by bolts, nails or other suitable means.

Referring now to FIGS. 3 and 4, the structural component of this invention is also shown as comprising an elongated substantially stiff flat metal member 19 dimensioned to correspond substantially to the upper surface of the top-plate 20 of the building frame. The structural component 19 is shown provided with spaced apertures 21 to receive bolts, nails or similar fastening means by which the component 19 is secured permanently to the top-plate 20. Further, the elongated structural component 19 is provided at modular distances therealong i.e. at 16 inch or 24 inch centers, as the case may be, with a plurality of pairs of laterally spaced upstanding flanges 22—22, each pair of flanges being spaced apart laterally a distance corresponding substantially to the thickness of a roof rafter 13 or equivalent structural member.

As shown especially well in FIG. 4 each flange 22 is substantially rectangular and may be a separately formed member welded substantially perpendicularly to the flat structural component 19; but is preferably formed as an integral part thereof by striking up each flange, of a pair of flanges, from the flat structural component 19 itself—using conventional metal forming procedures—thereby forming a substantially rectangular aperture 23 in said structural component between each pair of upstanding flanges. The width of each upstanding flange 22 may correspond substantially to the width (*w*) of the aperture 23; but is preferably substantially half the width (*w*) of the opening 23; while the length (or height) of each flange 22 is substantially equal to one half the length (*l*) of said opening 23. The flanges 22, like the flat structural component 19 from which they struck, are sufficiently thick to be stiff and substantially rigid so as to provide solid support for the lower ends of the roof truss rafters 13. To this end each flange may be provided with one or more nailing or bolting apertures 24 preferably punched through the flanges from the outer surface thereof in a manner to form a burr 25 on the inside surface of the flange. Thus when a wooden roof rafter is inserted between a pair of flanges and nailed or bolted therein the burr 25 will be pressed into adjacent surfaces of the rafter to securely lock the rafter against movement. Further, while the apertures 24 may be at right angles to the planes of the flanges each aperture 24 may also be made at an acute angle thereto to facilitate toe-nailing the flanges to the roof rafter, should that be preferred.

While the modular structural component of this invention has been described in connection with a building structure comprising wooden structural members i.e. roof rafters, truss rafters, top-plate etc. it will be understood that the invention is equally applicable to building structures, roof trusses, and the like, formed of steel.

The use of the modular structural component of this invention is doubtless obvious from the foregoing description but suffice it to say that in erecting a roof truss, for example, components 19 are nailed to the top-plates 20 as indicated in FIG. 4. Then the ridge member 14 is raised into position after which the roof rafters 13 are quickly and accurately fitted into the corresponding pairs of flanges 22—22 and 18—18, respectively, and securely fastened therein by suitable fastening means.

While the invention has been described and illustrated by the examples included herein it is not intended that the invention be strictly limited thereto and other variations and modifications may be employed within the scope of the appended claims.

I claim:

1. An elongated structual component adapted to be secured to the wooden frame of a building as a permanent component thereof for facilitating fixing the spacing of the structual members of said wooden frame during construction thereof, said elongated structual component consisting of relatively stiff, flat metal stock the longitudinal edges of which are continuous and in the plane of said flat metal stock, said elongated structual component having a plurality of pairs of stiff metal flanges integral therewith and spaced at modular distances along the length thereof, the flanges of each pair of flanges being arranged in spaced parallel relationship, substantially perpendicular to the plane of said elongated structual component and inwardly from the continuous elongated edges thereof, and each flange of a pair of flanges being struck up from that portion of the body of said elongated structual component between each pair of flanges thereby forming an opening in said flat metal stock between each pair of laterally spaced flanges, each flange corresponding in length to one half the length of said opening and in width to one half the width of said opening, and each flange having a plurality of apertures therein, each aperture formed at an acute angle to the plane of its respective flange to accomodate fastening means for permanently securing a wooden frame member between each of said pairs of flanges.

2. A structural component according to claim 1 wherein the apertures in said flanges are each formed with a burr projecting inwardly from the inside surface of its respective flange.

3. A structural component according to claim 1 wherein said structual component is substantially flat and arranged to be secured permanently to the top-plate of a building frame.

* * * * *